US009073055B1

(12) United States Patent
Fulton et al.

(10) Patent No.: US 9,073,055 B1
(45) Date of Patent: Jul. 7, 2015

(54) SYSTEMS AND METHODS FOR MILLING FLOUR

(71) Applicant: Unifine Mill LLC, Arlington, WA (US)

(72) Inventors: Stephen J. Fulton, Anacortes, WA (US); Ronald C. Anderson, Arlington, WA (US)

(73) Assignee: Unifine Mill LLC, Arlington, WA (US)

( * ) Notice: Subject to any disclaimer, the term of this patent is extended or adjusted under 35 U.S.C. 154(b) by 247 days.

(21) Appl. No.: 13/787,752

(22) Filed: Mar. 6, 2013

(51) Int. Cl.
*B02C 9/00* (2006.01)
*B02C 15/08* (2006.01)

(52) U.S. Cl.
CPC .. *B02C 15/08* (2013.01); *B02C 9/00* (2013.01)

(58) Field of Classification Search
CPC ..... B02C 9/00; B02C 9/02; B02C 11/08; B02C 18/06; B02C 18/12; B02C 18/22; B02C 19/0012
USPC ..... 241/18, 19, 57, 242
See application file for complete search history.

(56) References Cited

U.S. PATENT DOCUMENTS

| | | | |
|---|---|---|---|
| 2,211,518 | A | 8/1940 | Scherbaum |
| 2,507,507 | A | 12/1944 | Egedal |
| 3,488,008 | A | 1/1970 | Bodine |
| 3,589,625 | A | 6/1971 | Desbordes |
| 3,688,996 | A | 9/1972 | Kuest |
| 5,660,339 | A | 8/1997 | Scott et al. |
| 5,938,129 | A | 8/1999 | Forsyth |
| 8,017,172 | B2 | 9/2011 | Arndt et al. |
| 2007/0292583 | A1 | 12/2007 | Haynes et al. |

OTHER PUBLICATIONS

George T. Austin, "The Unifine Mill—A summary of data including milling, baking and consumer acceptance tests," Bulletin No. 298, Jun. 1967, 27 pages, College of Engineering Research Division, Technical Extension Service, Washington State University, Pullman, Washington.

Azure Standard Company, "Drawings of a flour mill produced and publicly used since around 2001, Doc. 1" 2001, 19 pages.

Azure Standard Company, "Drawings of a flour mill produced and publicly used since around 2001, Doc. 2" 2001, 12 pages.

Fairfield Milling Inc., "Use Unifine Flour," Unifine Flour Cookbook, 1960, 12 pages, Fairfield, Washington.

(Continued)

*Primary Examiner* — Mark Rosenbaum
(74) *Attorney, Agent, or Firm* — Michael R. Schacht; Schacht Law Office, Inc.

(57) ABSTRACT

A mill assembly for processing product comprises a mill housing assembly, at least first and second port assemblies defining an exterior inlet opening and an exterior outlet opening, at least one collection assembly, an air guide assembly, and a grinding assembly. In one form, a feed/collection ratio of the exterior inlet opening to the exterior outlet opening is at least approximately 1.5:1. In another form, seals are formed between the port assemblies and the mill housing assembly. In another form, the mill assembly operates in a first mode and a second mode. In the first mode, a ring plug plate and a wall plug plate are detached from the mill housing. In the second mode, the ring plug plate and the wall plug plate are attached to the mill housing to prevent air from flowing out of the third housing port.

20 Claims, 13 Drawing Sheets

(56) References Cited

OTHER PUBLICATIONS

George E. Pease et al., "Unifine Flour—Milling, Baking, and Consumer Acceptance Tests: Study of a grinding process for producing whole-wheat flour, determination of baking and keeping qualities, and commercial acceptability tests," Bulletin No. 206, Apr. 1950, 47 pages, Washington State Institute of Technology, Division of Industrial Research in Cooperation with Washington Agricultural Experiment Stations, The State College of Washington, Pullman, Washington.

Stevens et al., "The Effect of Particle Size on the Nutritional Characteristics of Unifine Flour," Food Research: An Official Publication of the Institute of Food Technologists, 1952, 8 pages, Scientific paper No. 1052, Project 850, Washington Agricultural Experiment Stations, Institute of Agricultural Sciences, The State College of Washington, Pullman, Washington.

SYSTEMS AND METHODS FOR MILLING FLOUR

TECHNICAL FIELD

The present invention relates to flour mill systems and methods, and, more particularly, to flour mill systems adapted to process relatively small quantities of grain to obtain flour.

BACKGROUND

A flour mill (also referred to as a grist mill) grinds grain into flour. Early flour mills were relatively small operations located a short distance from both the farms that grew the grain and the consumers of the flour produced. Traditionally, flour was milled using a fixed bottom stone and a rotating top stone. Grain is fed between the stones (typically through a hole in the top stone), and the stones grind the grain to obtain flour. Conventional stone mills operate at a rotational speed of approximately 120 rpm. Traditional flour mills simply grind the entire grain and do not separate the bran and germ from the endosperm.

Modern flour mills employ heavy steel or cast-iron rollers that are spun at high speed to process the grain into flour. Modern flour mills typically separate the bran and germ from the endosperm, and the bran and germ are subsequently recombined with the endosperm to obtain whole wheat flour.

Modern flour mills are large-scale operations that are not intended to operate using discrete, small batches of flour. The economics of modern flour mills also discourage the use of such mills to process discrete, small batches of flour.

The Unifine Mill is a high-speed rotary flour mill which grinds the entire wheat berry to fine flour in a single pass. The Unifine Mill was initially designed and tested by Washington State University (WSU) in 1950 as publicized in WSU Bulletin 206, dated April 1950. WSU performed additional tests on the Mill in 1967, as documented in WSU Bulletin 298, dated June, 1967.

Several unsuccessful attempts have been made since then to put the mill into production, with one exception: Azure Standard, located in Dufur, Oreg., built a Unifine Mill in 2001 and that mill is still producing flour today at a rate of approximately 1 million pounds of flour per year. For clarity, the Unifine Mill operated by Azure Standard will be referred to herein as the Azure Standard Mill.

The Azure Standard Mill is configured to process discrete, small batches of flour and is economically viable when so used. However, since its inception, the Azure Standard Mill has experienced the following problems: flour clogs the mill if the feed rate is too high; air gaps in the mill's design lets flour escape from the mill into surrounding air, creating a dust explosion hazard; output capacity of the mill is too small for larger commercial applications.

The need thus exists for improved flour mills that function, both operationally and economically, when operated on a small scale but which do not exhibit the problems experienced by the Azure Standard Mill.

SUMMARY

The present invention may be embodied as a mill assembly for processing product comprising a mill housing assembly, an air guide assembly, and a grinding assembly. The mill housing assembly comprises a mill housing, first and second port assemblies, and at least one collection assembly. The mill housing defines a housing chamber, at least first and second housing ports, at least one vent port, and at least first and second port assemblies secured to the mill housing at the first and second housing ports, respectively. The first and second port assemblies each defines an inlet chamber, an exterior inlet opening, an outlet chamber, and an exterior outlet opening. The at least one collection assembly defines a collection chamber in fluid communication with the outlet chamber of each of the first and second port assemblies and an exterior collection opening. The air guide assembly arranged within the housing chamber defines an inlet plenum in fluid communication with at least one vent port, a wheel chamber, and at least first and second gap paths associated with the first and second housing ports, respectively. The grinding assembly comprises a rotor member and a plurality of grinding members. The rotor member is arranged within the housing chamber to define a grinding chamber. Each of the inlet chambers is in fluid communication with the grinding chamber, and at least one feed chamber extending between the inlet plenum and grinding chamber. The plurality of grinding members is supported by the rotor member within the grinding chamber. The product is arranged at least partly within the grinding chamber through the exterior inlet opening of a given one of the port assemblies and the inlet chamber associated with the given one of the port assemblies. The rotor member is rotated such that the grinding members grind the product within the collection chamber and displace the product being ground from a first position adjacent to the inlet chamber of the first port assembly to a second position adjacent to the outlet chamber of the second port assembly. Air flows along a first path from the at least one inlet port, through the inlet plenum, the at least one gap path, the grinding chamber, the outlet chamber, and the collection chamber, and out of the exterior collection opening, and a second path from the at least one inlet port, through the inlet plenum, the at least one feed chamber, the grinding chamber, the outlet chamber, and the collection chamber, and out of the exterior collection opening. The air flowing along the first and second paths carries ground product from the grinding chamber into the outlet chamber, through the collection chamber, and out of the exterior collection opening. A feed/collection ratio of the exterior inlet opening to the exterior outlet opening is at least approximately 1.5:1.

The present invention may be embodied as a mill assembly for processing product comprising a mill housing assembly, an air guide assembly, and a grinding assembly. The mill housing assembly comprises a mill housing, first and second port assemblies, and at least one collection assembly. The mill housing defines a housing chamber, at least first and second housing ports, at least one vent port, and at least first and second port assemblies secured to the mill housing at the first and second housing ports, respectively. The first and second port assemblies each defines an inlet chamber, an exterior inlet opening, an outlet chamber, and an exterior outlet opening. The at least one collection assembly defines a collection chamber in fluid communication with the outlet chamber of each of the first and second port assemblies and an exterior collection opening. The air guide assembly arranged within the housing chamber defines an inlet plenum in fluid communication with at least one vent port, a wheel chamber, and at least first and second gap paths associated with the first and second housing ports, respectively. A seal is formed between each of the first and second port assemblies and the mill housing substantially around the first and second housing ports. The grinding assembly comprises a rotor member and a plurality of grinding members. The rotor member is arranged within the housing chamber to define a grinding chamber. Each of the inlet chambers is in fluid communication with the grinding chamber, and at least one feed chamber extending between the inlet plenum and grinding chamber. The plurality of grinding members is supported by the rotor member within the grinding chamber. The product is arranged at least partly within the grinding chamber through the exterior inlet opening of a given one of the port assemblies and the inlet chamber associated with the given one of the port assemblies. The rotor member is rotated such that the grinding members grind the product within the collection chamber and displace the product being ground from a first position adjacent to the inlet chamber of the first port assembly to a second position adjacent to the outlet chamber of the second port assembly. Air flows along a first path from the at least one inlet port, through the inlet plenum, the at least one gap path, the grinding chamber, the outlet chamber, and the collection chamber, and out of the exterior collection opening, and a second path from the at least one inlet port, through the inlet plenum, the at least one feed chamber, the grinding chamber, the outlet chamber, and the collection chamber, and out of the exterior collection opening. The air flowing along the first and second paths carries ground product from the grinding chamber into the outlet chamber, through the collection chamber, and out of the exterior collection opening.

The present invention may also be embodied as a mill assembly for processing product comprising a mill housing assembly, an air guide assembly, a grinding assembly, at least one ring plug plate, and at least one wall plug plate. The mill housing assembly comprises a mill housing, at least first, second, and third port assemblies, and at least one collection assembly. The mill housing defines a housing chamber, at least first, second, and third housing ports, and at least one vent port. At least first, second, and third port assemblies are selectively detachably attached to the mill housing at the first, second and/or third housing ports, respectively. The port assemblies each defines an inlet chamber, an exterior inlet opening, an outlet chamber, and an exterior outlet opening. The at least one collection assembly defines a collection chamber in fluid communication with the outlet chamber of each of the first and second port assemblies and an exterior collection opening. The air guide assembly is arranged within the housing chamber to define an inlet plenum in fluid communication with at least one vent port, a wheel chamber, and at least first, second, and third gap paths associated with the first, second, and third housing ports, respectively. The grinding assembly comprises a rotor member and a plurality of grinding members. The rotor member is arranged within the housing chamber to define a grinding chamber, where each of the inlet chambers is in fluid communication with the grinding chamber and at least one feed chamber extending between the inlet plenum and grinding chamber. The plurality of grinding members is supported by the rotor member within the grinding chamber. The product is arranged at least partly within the grinding chamber through the exterior inlet opening of a given one of the port assemblies and the inlet chamber associated with the given one of the port assemblies. The rotor member is rotated such that the grinding members grind the product within the collection chamber and displace the product being ground along the grinding chamber. Air flows along a first path from the at least one inlet port, through the inlet plenum, the at least one gap path, the grinding chamber, the outlet chamber, and the collection chamber, and out of the exterior collection opening. A second path from the at least one inlet port, through the inlet plenum, the at least one feed chamber, the grinding chamber, the outlet chamber, and the collection chamber, and out of the exterior collection opening. The air flowing along the first and second paths carries ground product from the grinding chamber into the outlet chamber, through the collection chamber, and out of the exterior collection opening. The mill assembly operates first and second modes. In the first mode, the at least one ring plug plate and the at least one wall plug plate are detached from the mill housing and the first port assembly, the second assembly, and a third port assembly are secured to the housing at the first, second, and third housing ports, respectively. In the second mode, the at least one ring plug plate and the at least one wall plug plate are attached to the mill housing to prevent air from flowing out of the third housing port, the first and second port assemblies are secured to the housing at the first and second housing ports, respectively, and the third port assembly is detached from the third housing port.

The present invention may also be embodied as a method of processing product comprising the following steps. A mill housing assembly defining a housing chamber is provided. At least first and second port assemblies each defining an exterior inlet opening and an exterior outlet opening are provided. A feed/collection ratio of the exterior inlet opening to the exterior outlet opening is at least approximately 1.5:1. At least one collection assembly is attached to the at least first and second port assemblies. An air guide assembly is mounted within the housing chamber to define a grinding chamber. A grinding assembly comprising a plurality of grinding members is arranged at least partly within the grinding chamber. The product is introduced into the grinding chamber through the exterior inlet opening. The grinding member is rotated such that the grinding members grind the product within the grinding chamber. Air is caused to flow through the mill housing assembly such that ground product is carried out of the first and second port assemblies through the exterior outlet opening.

DETAILED DESCRIPTION

The present invention may be embodied in a number of formats, and several examples of these embodiments will be discussed separately herein.

I. First Example

Figure 1:
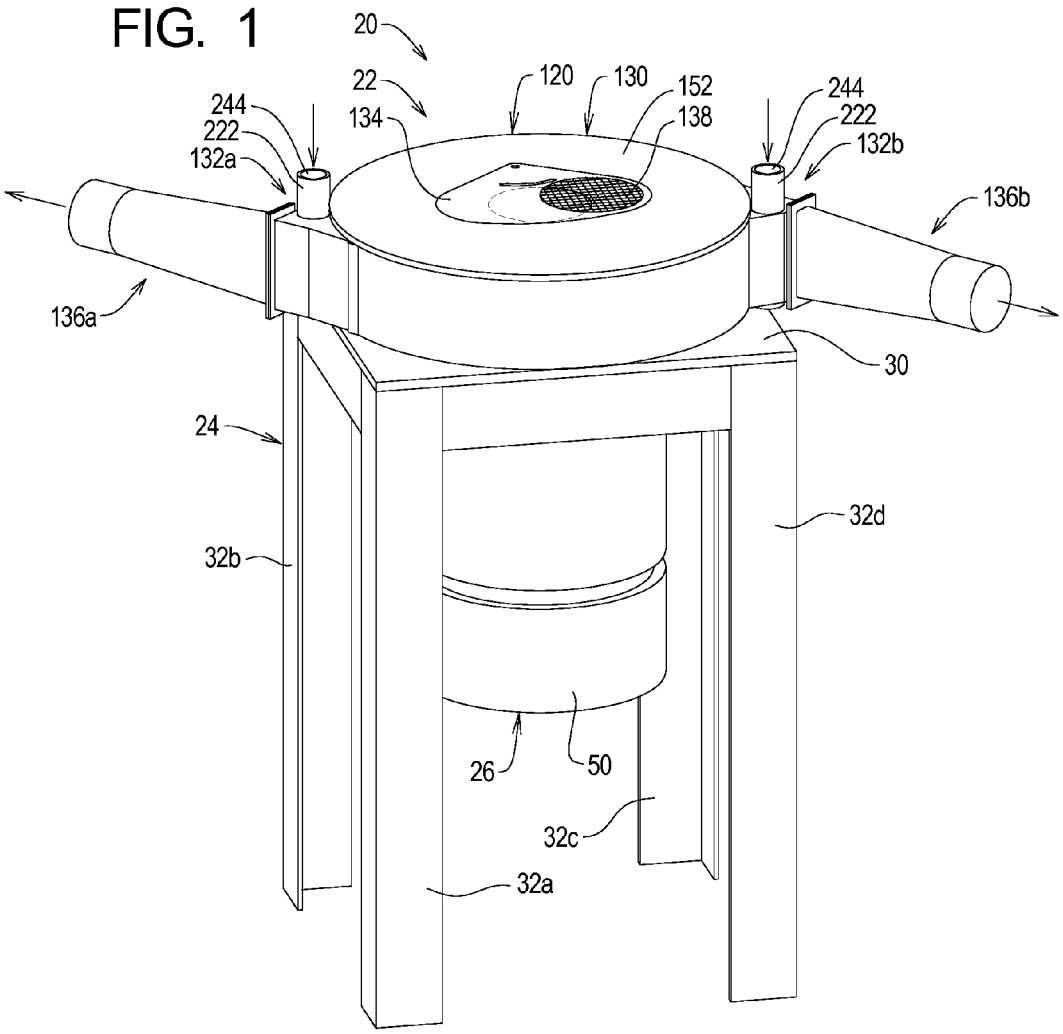
FIG. 1 is a perspective view of a first example flour mill system of the present invention.
Figure 2:
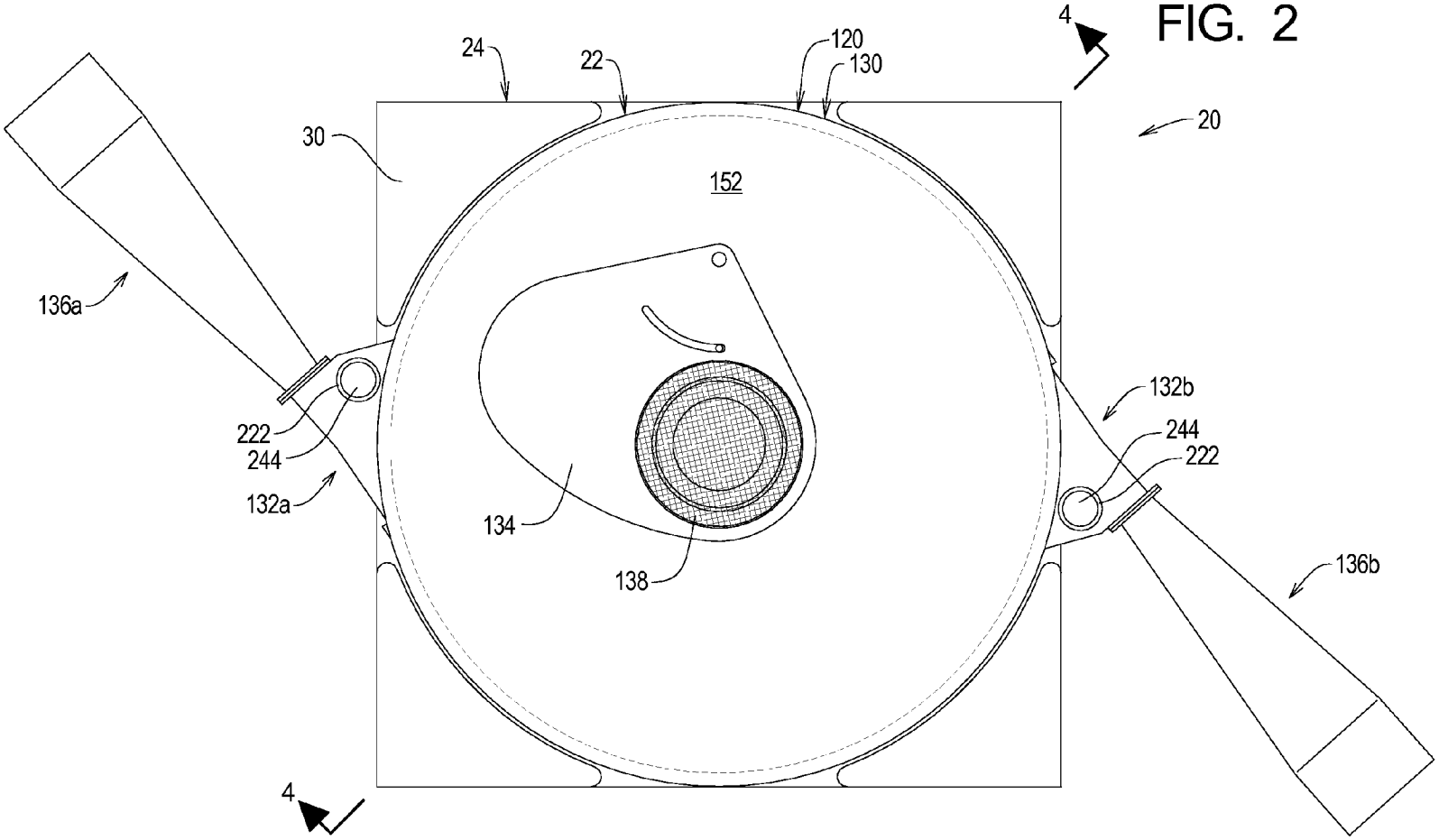
FIG. 2 is a top plan view of the first example flour mill system.
Figure 3:
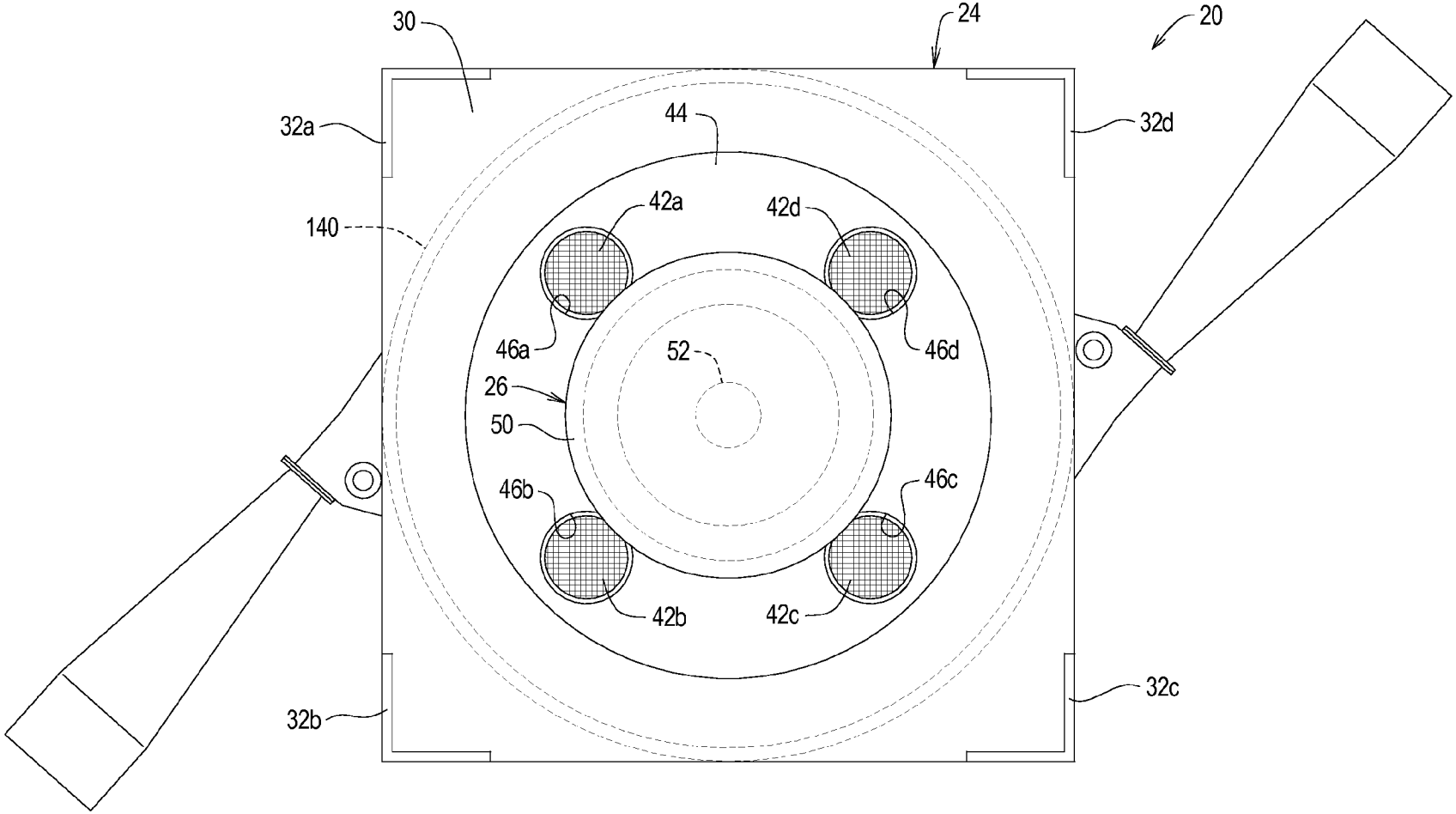
FIG. 3 is a bottom plan view of the 1$^{st}$ example flour mill system.

Referring initially to FIG. 1 of the drawing, depicted at therein is a first example flour mill system 20 constructed in accordance with, and embodying, the principles of the present invention. The example flour mill system 20 comprises a flour mill assembly 22, a support assembly 24, and a motor assembly 26.

The example support assembly 24 is a table-like structure comprising a support platform 30 and a plurality of legs 32. The support platform 30 defines a platform opening 40 and a plurality of bottom vent openings 42. The example support assembly 24 comprises first, second, third, and fourth legs 32*a*, 32*b*, 32*c*, and 32*d* and defines the first, second, third, and fourth bottom vent openings 42*a*, 42*b*, 42*c*, and 42*d*.

In the example support assembly 24, a bottom vent plate 44 is movably mounted relative to the support platform 30 as will be described in further detail below. The example bottom vent plate 44 defines at least one bottom vent plate opening 46. In particular, the example bottom vent plate defines first, second, third, and fourth bottom vent openings 46*a*, 46*b*, 46*c*, and 46*d* associated with the first, second, third, and fourth bottom vent openings 42*a*, 42*b*, 42*c*, and 42*d*, respectively. Each of the bottom vent plate openings 46 is formed by a plurality of individual perforations formed in the bottom vent plate 44 or, alternatively, may be formed by a screen arranged over a single large perforation in the bottom vent plate 44.

The motor assembly 26 comprises a motor 50 and a motor shaft 52. The motor 50 is mounted below the support platform 30 such that the motor shaft 52 extends through the platform opening 40.

In this discussion, numerical reference characters used without letter suffixes refer to components generically, while the same numerical reference characters used with letter suffixes refer to specific components of the examples depicted in the drawing. In this context, any numerical reference character used in the written specification without an appended letter suffix is supported by that same numerical reference character used with an appended letter suffix in the drawing.

Figure 4:
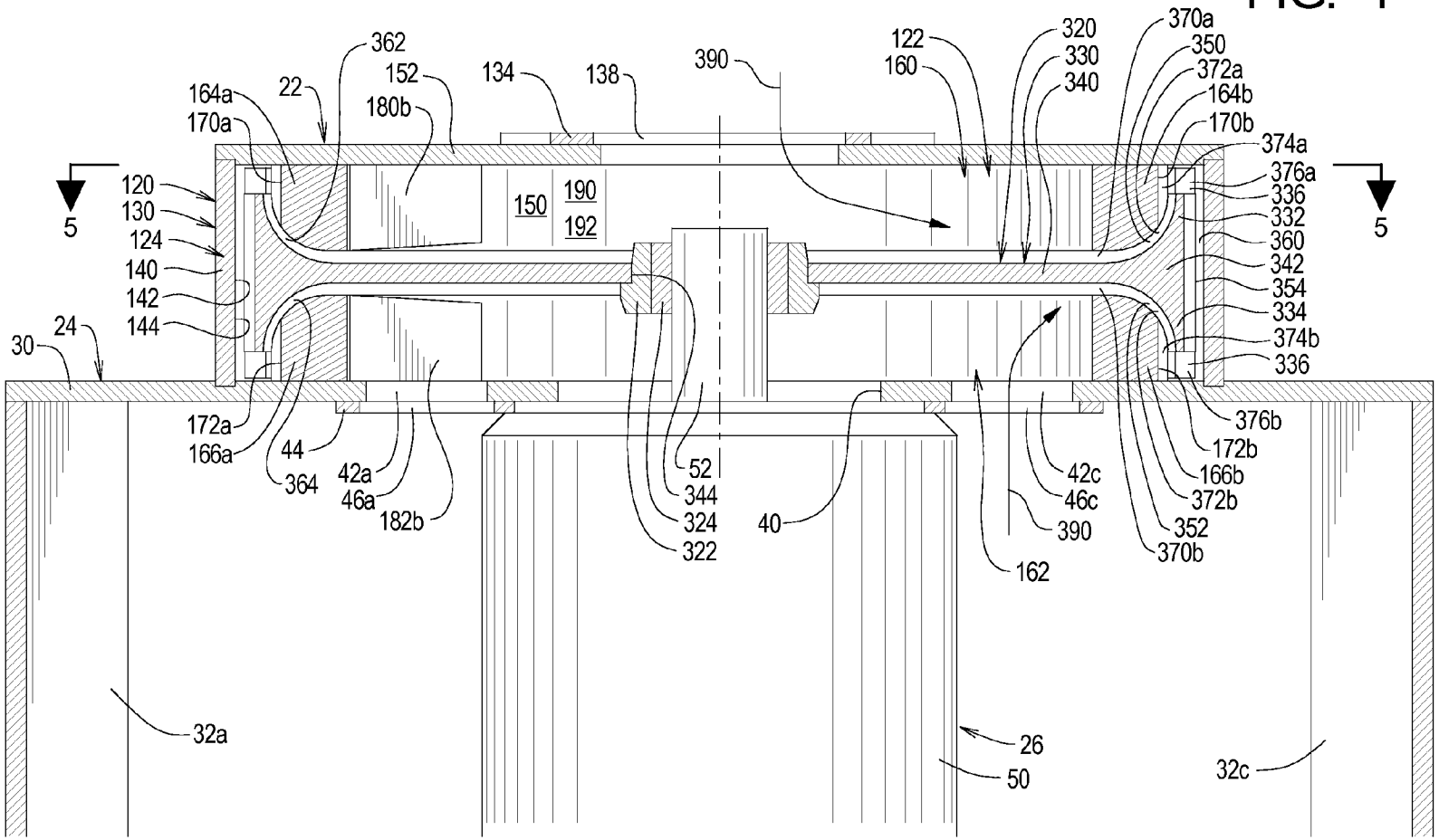
FIG. 4 is a partial section view taken along lines 4-4 in FIG. 2.

As perhaps best shown in FIG. 4, the example flour mill assembly 22 comprises a mill housing assembly 120, an air guide assembly 122, and a grinding assembly 124. The mill housing assembly 120 comprises a mill housing 130, a plurality of port assemblies 132, a top vent plate 134, and a plurality of collection assemblies 136. The example mill housing assembly 120 comprises first and second port assemblies 132*a* and 132*b* and first and second collection assemblies 136*a* and 136*b*. The example top vent plate 134 defines a top vent opening 138. The example top vent opening 138 is formed by a plurality of individual perforations formed in the top vent plate 134 or, alternatively, may be formed by a screen arranged to cover a single large perforation in the top vent plate 134.

Figure 6:
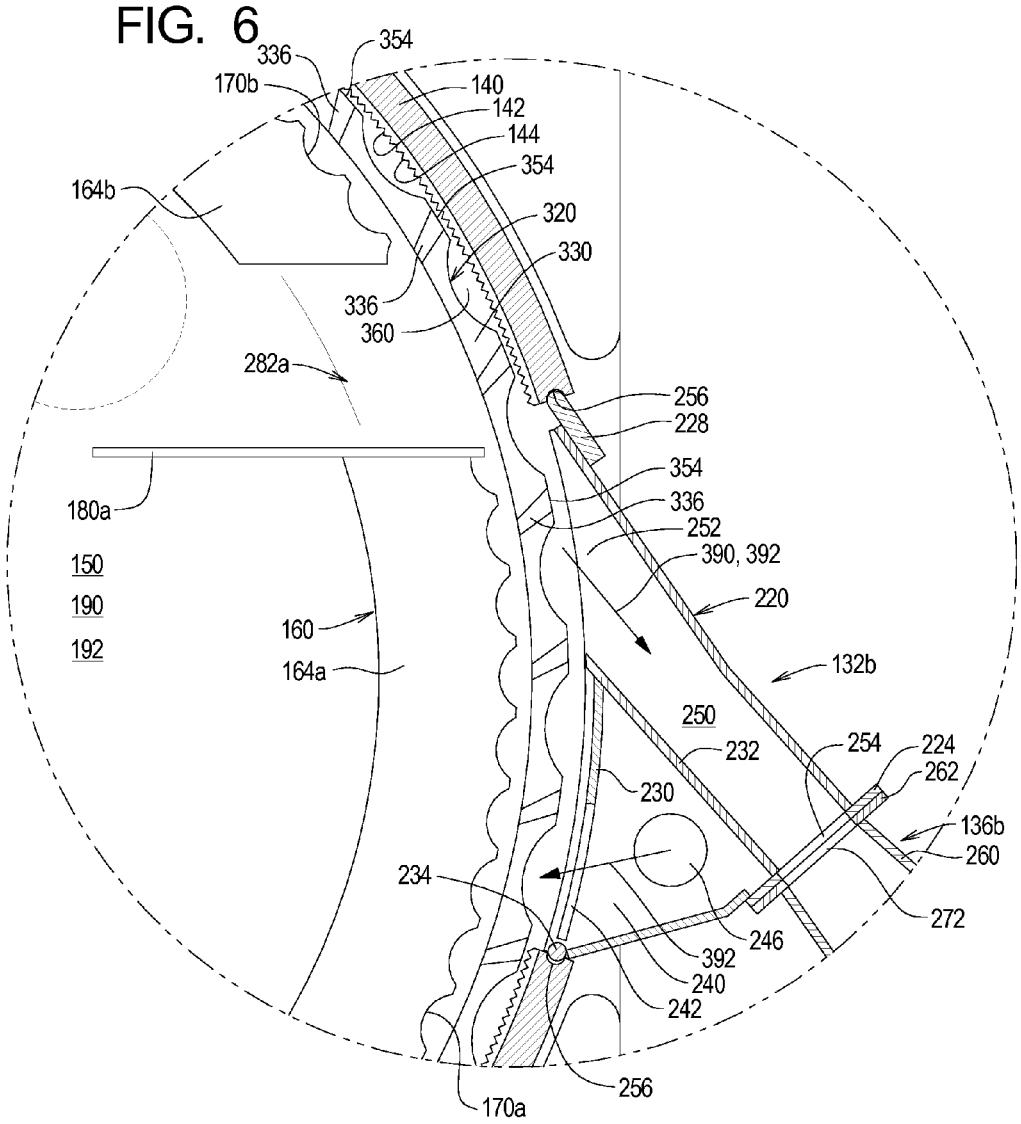
FIG. 6 is a close-up view of a portion of FIG. 5 as indicated in FIG. 5.

As perhaps best shown in FIG. 6, the mill housing 120 defines a perimeter wall 140 to which is attached a mill lining 142. The example perimeter wall 140 is cylindrical, and the mill lining 142 defines a corrugated static mill surface 144 that follows the cylindrical path defined by the perimeter wall 140.

In the first example flour mill system 20, the support platform 30 and the bottom vent plate 44 form a bottom wall of the mill housing assembly 120. In particular, the example mill housing 130 is secured to the support platform 30 to define a housing chamber 150. Alternatively, a separate bottom wall plate defining the bottom vent openings 42 may be provided, and the vent plate 44 may be movably secured to the separate bottom wall plate. The example mill housing 130 further defines a top vent opening 152, and a plurality of port openings 154 are formed in the perimeter wall 140.

Figure 5:
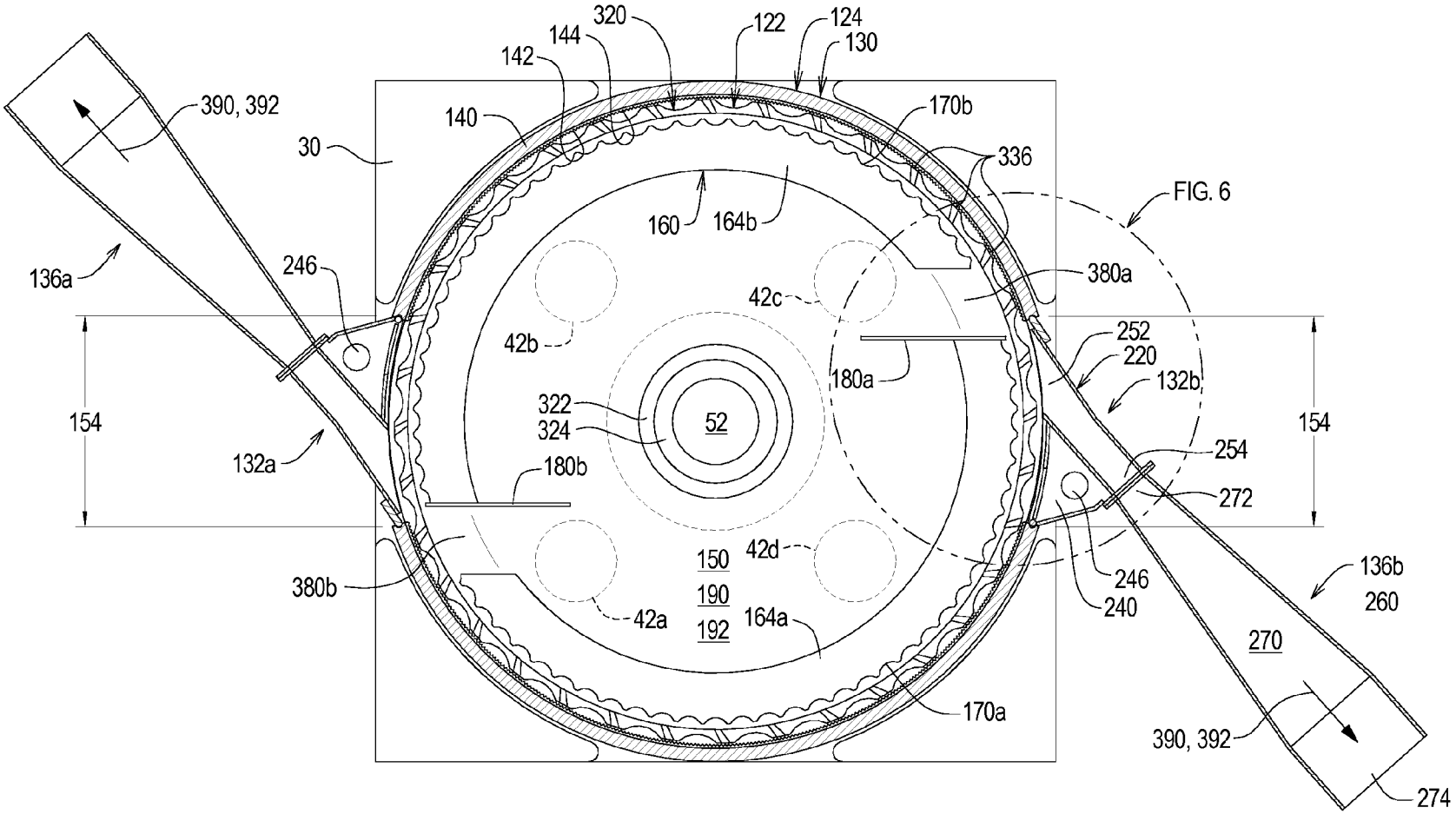
FIG. 5 is a partial section view taken along lines 5-5 in FIG. 4.
Figure 7:
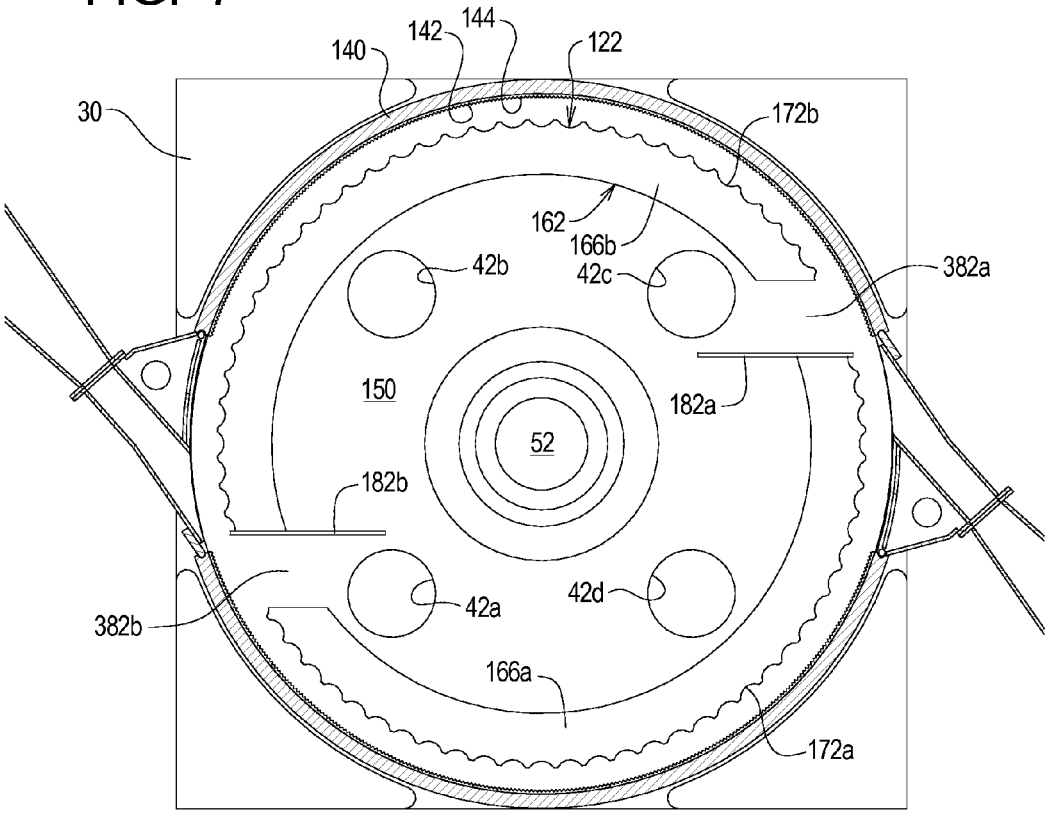
FIG. 7 is a top plan partial section view of the air guide assembly of the first example flour mill system.

Referring now to FIGS. 4, 5 and 7 of the drawing, it can be seen that the example air guide assembly 122 comprises upper and lower ring assemblies 160 and 162. The upper ring assembly 160 comprises first and second upper ring members 164*a* and 164*b*, and the lower ring assembly 162 comprises first and second lower ring members 166*a* and 166*b*. First and second upper ring outer walls 170*a* and 170*b* are formed by the upper ring members 164*a* and 160*b*, respectively. First and second lower ring outer walls 172*a* and 172*b* are formed by the lower ring members 166*a* and 166*b*, respectively.

First and second upper guide plates 180*a* and 180*b* are secured to the upper ring members 164*a* and 164*b*, respectively. First and second lower guide plates 182*a* and 182*b* are secured to the lower ring members 166*a* and 166*b*, respectively.

In combination with the mill housing assembly 120, the example air guide assembly 122 defines an inlet plenum 190 and a wheel chamber 192.

Figure 8:
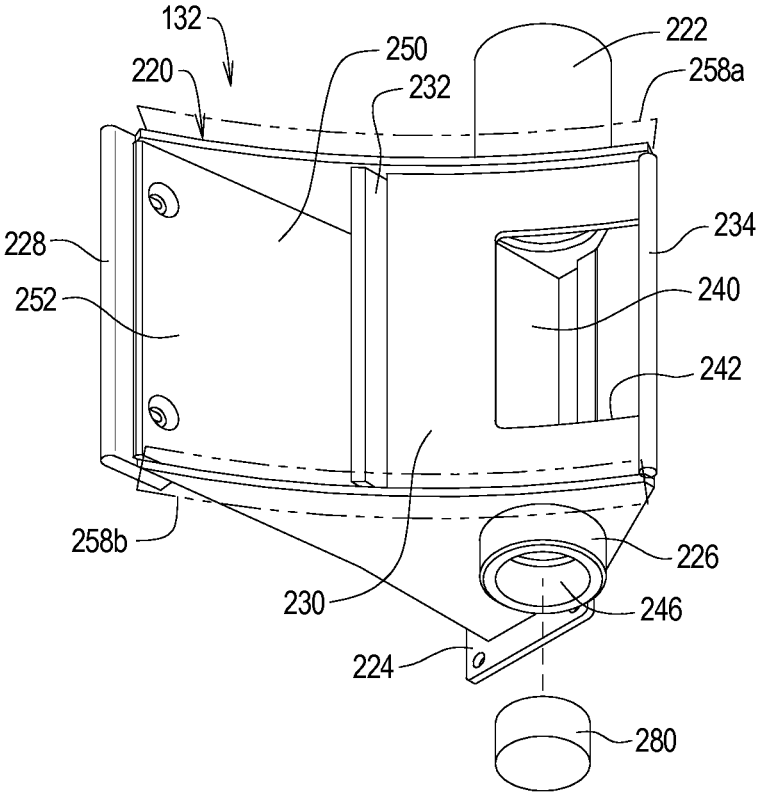
FIG. 8 is a perspective view of a port housing forming a part of a mill housing assembly of the first example flour mill system.
Figure 9A:
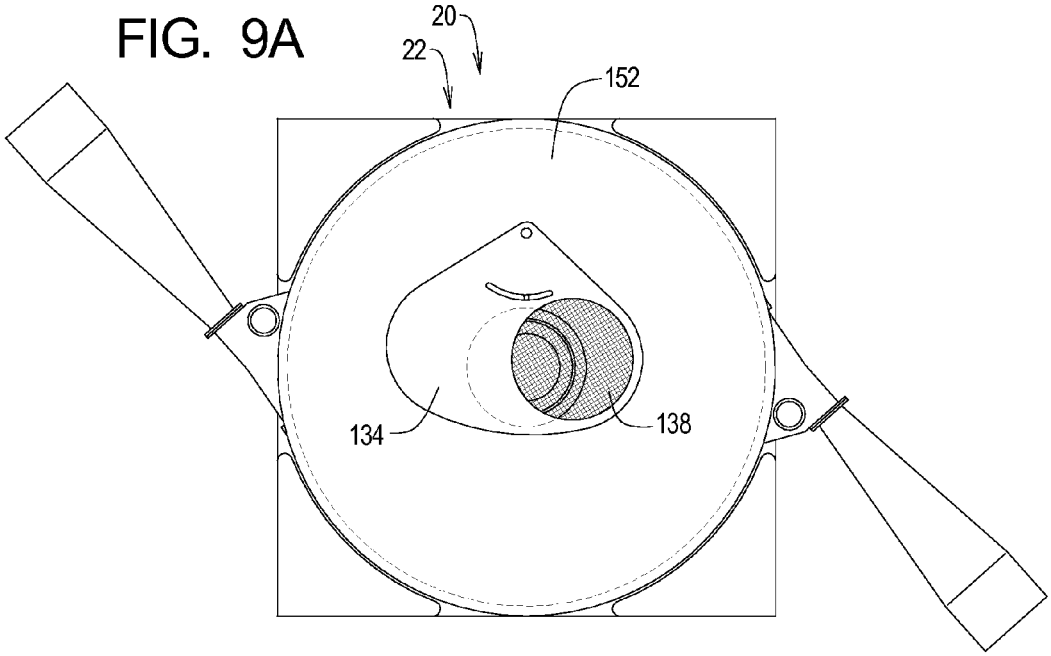
FIGS. 9A and 9B are top plan views depicting the use of a top vent plate forming part of the example mill housing assembly.
Figure 9B:
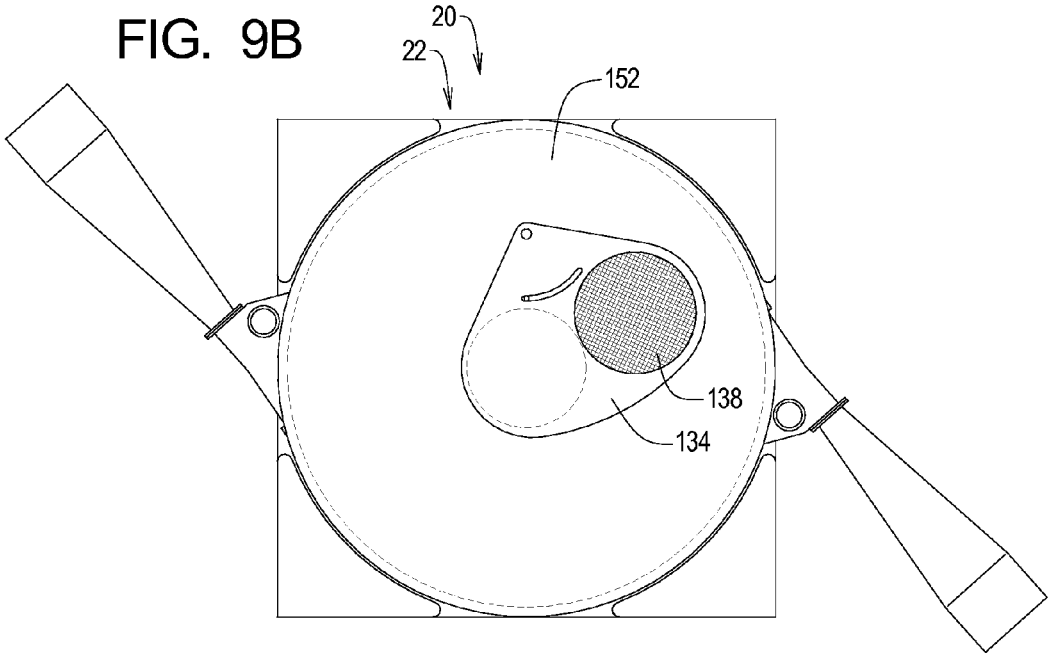
Figure 10A:
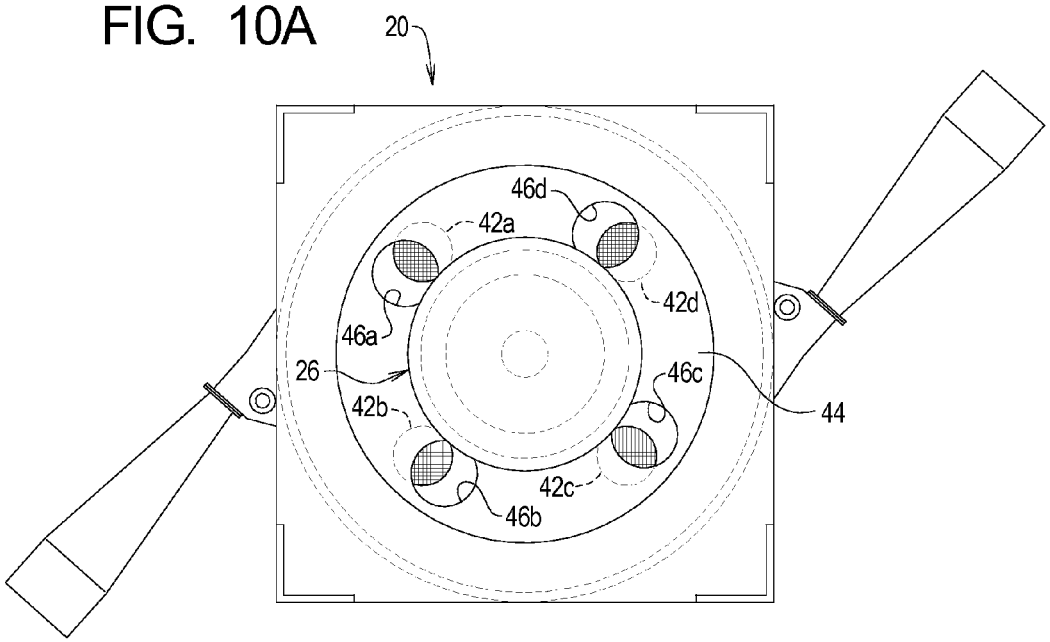
FIGS. 10A and 10B are top plan views depicting the use of a bottom vent plate forming part of the example mill housing assembly.
Figure 10B:
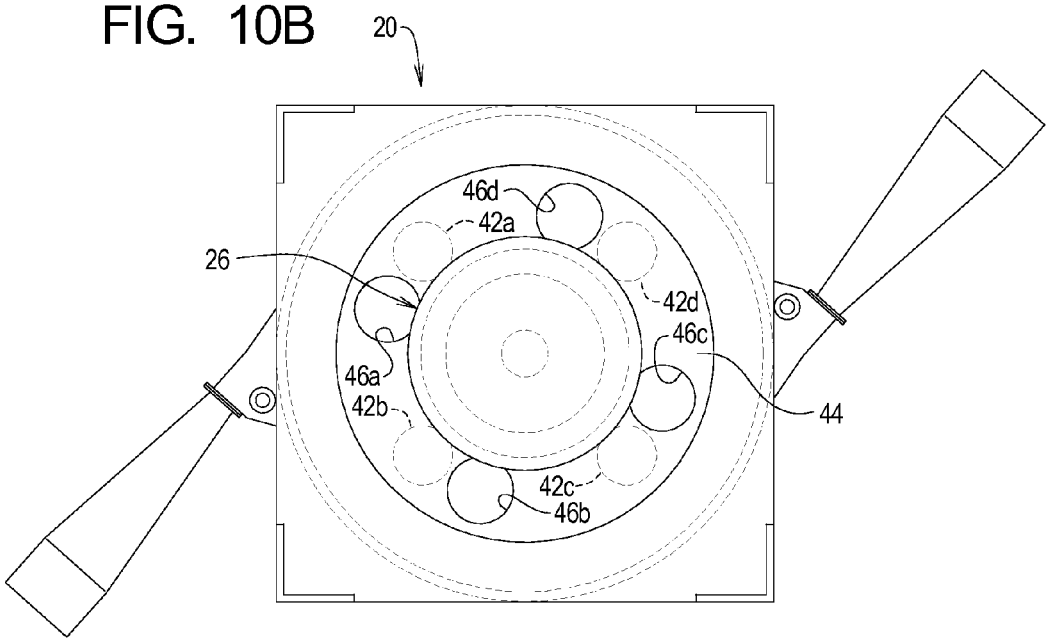

FIGS. 6 and 8 illustrate that each of the example port assemblies 132 comprise a port housing 220, an inlet tube 222, an outlet flange 224, a cleaning tube 226, and a seal bar 228. Within the port housing 220 is arranged an inlet wall 230 and an outlet wall 232. A seal rod 234 is formed on the port housing 220 as will be described in further detail below.

The port housing 220 and the inlet wall 230 define an inlet chamber 240. The inlet wall 230 defines an interior inlet opening 242. The interior inlet opening 242 is in fluid communication with the wheel chamber 192 as will be described in further detail below. The port housing 220 defines an exterior inlet opening 244 and a cleaning opening 246. The inlet tube 222 surrounds the exterior inlet opening 244, and the cleaning tube 226 surrounds the cleaning opening 246.

The port housing 220 and the outlet wall 232 define an outlet chamber 250. The outlet chamber 250 is in fluid communication with the wheel chamber 192 through an interior outlet opening 252, and an exterior outlet opening 254 allows fluid communication with an exterior of the port housing 220.

A port housing 220 is secured to the mill housing 130 over each of the port openings 154. In particular, the perimeter wall 140 of the mill housing 130 defines a mounting groove 256 along a vertical edge of each of the port openings 154. The seal rod 234 of the port housings 220 engages the mounting groove 256 to form a seal along a first vertical edge of the port housings 220 where the port housings 220 engages the mill housing 130. A second vertical edge of the port housings 220 is sealed to the mill housing 130 by the seal bar 228. Upper and lower seal tape members 258*a* and 258*b* are arranged to seal the curved upper and lower horizontal edges to the corresponding upper and lower edges, respectively, of the port housings 220 to the mill housing 130. The seal tape members 258*a* and 258*b* may take the form of lengths of PTFE gasket tape.

FIGS. 5 and 6 perhaps best illustrate that one of the collection assemblies 136 is associated with and detachably attached to each of the port housings 220. In particular, the example collection assemblies 136 each defines a collection tube 260 from which extends a collection tube flange 262. Each collection tube 260 defines a collection chamber 270 having an interior collection opening 272 and an exterior collection opening 274. Each collection tube flange 262 is connected to one of the outlet flanges 224 such that the interior collection openings 272 of the collection tubes 260 are in fluid communication with the exterior outlet openings 254 defined by the port housings 220. During normal operation of the first example flour mill assembly 22, a cleaning tube plug 280 (FIG. 8) is arranged within the cleaning tube 226 to close the cleaning opening 246.

Turning now to FIGS. 4 and 6 of the drawing, it can be seen that the example grinding assembly 124 comprises rotor assembly 320, a collar 322, and a sleeve 324. The rotor assembly 320 comprises a rotor member 330, an upper flange 332, and a lower flange 334, and grinding members 336. The example rotor member 330 comprises a disc portion 340, a rim portion 342, and a hub opening 344. Upper flange scallops 350 are formed on the upper flange 332, while lower flange scallops 352 are formed on the lower flange 334. The grinding members 336 define grinding surfaces 354.

As discussed above, the motor shaft 52 extends through the platform opening 40. Accordingly, a distal end of the motor shaft 52 is arranged within the housing chamber 150. The collar 322 and sleeve 324 extend through the hub opening 344 to mount the rotor member 330 onto the distal end of the motor shaft 52.

When the mill housing assembly 120 air guide assembly 122, and grinding assembly 124 are combined to form the flour mill assembly 22, the motor shaft 52, collar 322, and sleeve 324 are arranged within the inlet plenum 190. The upper flange 332, lower flange 334, and grinding members 336 are arranged within the wheel chamber 192 to define a grinding chamber 360, upper feed chamber 362, and lower feed chamber 364. The upper feed chamber 362 defines an upper proximal portion 370*a*, an upper intermediate portion 372*a*, and an upper distal portion 374*a*. Similarly, the lower feed chamber 364 defines a lower proximal portion 370*b*, a lower intermediate portion 372*b*, and a lower distal portion 374*b*. The upper and lower proximal portions 370*a*, and 370*b* are in fluid communication with the inlet plenum 190. The upper and lower distal portions 374*a* and 374*b* are in fluid communication with the grinding chamber 360 through upper and lower scallop cavities 376*a* and 376*b* defined by the upper flange scallops 350 and lower flange scallops 352, respectively.

In addition, perhaps best shown in FIGS. 4,5, and 7, the inlet plenum 190 is also in fluid communication with the grinding chamber 360 through upper gap paths 380 and lower gap paths 382. In particular, first and second upper gap paths 380*a* and 380*b* are formed between the upper ring members 164*a* and 164*b* and the upper guide plates 180*a* and 180*b*, respectively. Similarly, first and second lower gap paths 382*a* and 382*b* are formed between the lower ring members 166*a* and 166*b* and the lower guide plates 182*a* and 182*b*, respectively. The guide plates 180 and 182 guide or direct air from the inlet plenum 190 along the gap paths 380 and 382. Each of the gap paths 380 and 382 is located adjacent to the exterior outlet opening 252 of the port housings 220 as will be described in further detail below.

From the foregoing description, it can be seen that the example flour mill assembly 22 defines an air flow path 390 starting at the bottom vent openings 42 and/or top vent opening 138 and terminating at the exterior collection openings 274. A vacuum is applied to the exterior collection openings 274 defined by the collection tubes 260 to draw air along the air flow path 390. In addition, air may be forced into the bottom vent openings 42 and/or top vent opening 138 to facilitate movement of air along the air flow path 390. In any event, air is caused to flow along the air flow path 390 as will be described in further detail below.

The air flow path 390 allows ambient air to flow into the inlet plenum 190 along an inlet path portion through the bottom vent openings 42 and/or the top vent opening 138. From the inlet plenum 190, a primary feed portion path is formed from the inlet plenum 190 to the grinding chamber 360 through the gap paths 380 and 382. A secondary feed path portion allows ambient air to flow into the grinding chamber 360 through the upper feed chamber 362 and lower feed chamber 364 and the scallop cavities 376. An exit path portion allows air within the grinding chamber 360 to flow out of the flour mill assembly 22 through the outlet chambers 250 defined by the port housings 220 and the collection chambers 270 defined by the collection tubes 260.

In addition, the foregoing description makes it clear that a product path 392 extends from the exterior inlet openings 244 to the exterior outlet openings 254 of the port housings 220. In particular, product to be processed by the example flour mill assembly 22 is inserted into the inlet chamber 240 through the exterior inlet opening 244. From the inlet chamber 240, the product enters the grinding chamber 360 through the interior inlet openings 242. The product within the grinding chamber 360 is carried from through the interior inlet opening 242 associated with a first one of the port housings 220 to the interior outlet opening 252 associated with the a second or next one of the port housings 220 in the direction of rotation of the rotor member 330. The product then exits the grinding chamber 360 through the interior outlet opening 252 and enters the outlet chamber 250 of the second or next one of the port housings 220. From the outlet chamber 250, the product passes through the collection chamber 270 and out of the exterior collection opening 274.

Air drawn along the air flow path 390 is mixed with the product within the grinding chamber 360. The product to be processed will initially be primarily gravity fed into the grinding chamber 360 from the inlet chamber 240. After the product enters the grinding chamber 360, the product is ground between the grinding surfaces 354 defined by the grinding members 336 and the static mill surface 144 defined by the mill lining 142 associated with the mill housing perimeter wall 140. This grinding action processes the product within the grinding chamber 360 from larger particles that enter the grinding chamber 360 from the inlet chamber 240 to small, fine particles by the time the product reaches the next interior outlet opening 252. The grinding members 336 further displace the product being processed around the grinding chamber 360. Air flowing along the secondary feed path portion moves the product around within the grinding chamber 360 between adjacent grinding members 336 to help ensure that the product is completely ground to a desired fineness by the time the product reaches the next interior outlet opening 252. Air flowing along the secondary feed path portion will further tend to move finer particles of ground product around the grinding chamber 360 in the direction of the nearest low pressure region, typically the outlet chamber 250 associated with the next interior outlet opening 252.

When the ground product reaches the next interior outlet opening 252, the product will be entrained by air flowing along the primary feed path portion of the air flow path 390 such that the ground product is carried out of the grinding chamber 360 and into the outlet chamber 250 of the port housing 220 through the interior outlet opening 252. The air flowing along the exit path portion of the air flow path 390, with the ground product entrained thereby, will exit the flour mill assembly 22 through the collection chamber 270.

The following features of the example flour mill assembly 22 improve the operation thereof relative to the Unifine Mill operated by Azure Standard.

First, flow of product along the product flow path 392 is improved by enlarging the cross-sectional area of the interior collection opening 272 relative to a similar opening defined by the Azure Standard Mill. In particular, a feed/collection ratio of the cross-sectional area of the exterior collection opening 274 relative to the cross-sectional area of the exterior inlet opening 242 is approximately 2:1 or within a first preferred range of substantially between 1.5:1 and 5.0:1 and in any event should be within a second preferred range of greater than approximately 1.5:1.

Fabrication of the collection tube 260 out of stainless steel further increases the flow rate of product out of the grinding chamber 360. Second, the seal bar 228, seal rod 234, and seal tape 258 prevent flow of fluid between the mill housing 130 and the port housing 220.

Finally, the use of multiple port housings 220 spaced at intervals about the perimeter of the mill housing 130 allows the size of the grinding chamber 360 of the first example flour mill assembly 22 to be increased without over-processing the product being milled thereby. Finally, the bottom vent plate 44 and the top vent plate 134 are used to control the flow of air into the inlet chamber 240

By appropriately selecting the feed/collection ratio, making the collection tube 260 out of stainless steel and increasing the size of the grinding assembly 124, sealing junctures between the mill housing 130 and the port housings 220, increasing the size of the grinding chamber 360, and controlling flow of air through the vent openings 46 and 138, the following characteristics of the first example flour mill assembly 22 are improved.

The first example flour mill assembly 22 runs cooler than the Azure Standard Mill because the flour exits the mill faster. Studies have shown that running flour mills at higher temperature increases rancidity and reduces shelf life, so the ability of the first example flour mill assembly improves the shelf life of the flour produced thereby. In addition, the feed rate of product into the first example flour mill assembly 22 is increased by as much as 50% in comparison to the feed rate of product through the Azure Standard Mill, depending upon the time of grain being milled. Similarly, maximum output of the first example flour mill assembly 22 is increased by as much as 200% in comparison to the feed rate of product through the Azure Standard Mill, depending upon the time of grain being milled. The improved seal between the port housings 220 and the mill housing 130 significantly reduces leakage of flour dust and any hazards associated therewith. Finally, the movable vent plates 44 and 134 allows the flow of air through the first example flour mill assembly 22 to be tuned for a particular product being processed.

II. Second Example

Figure 11:
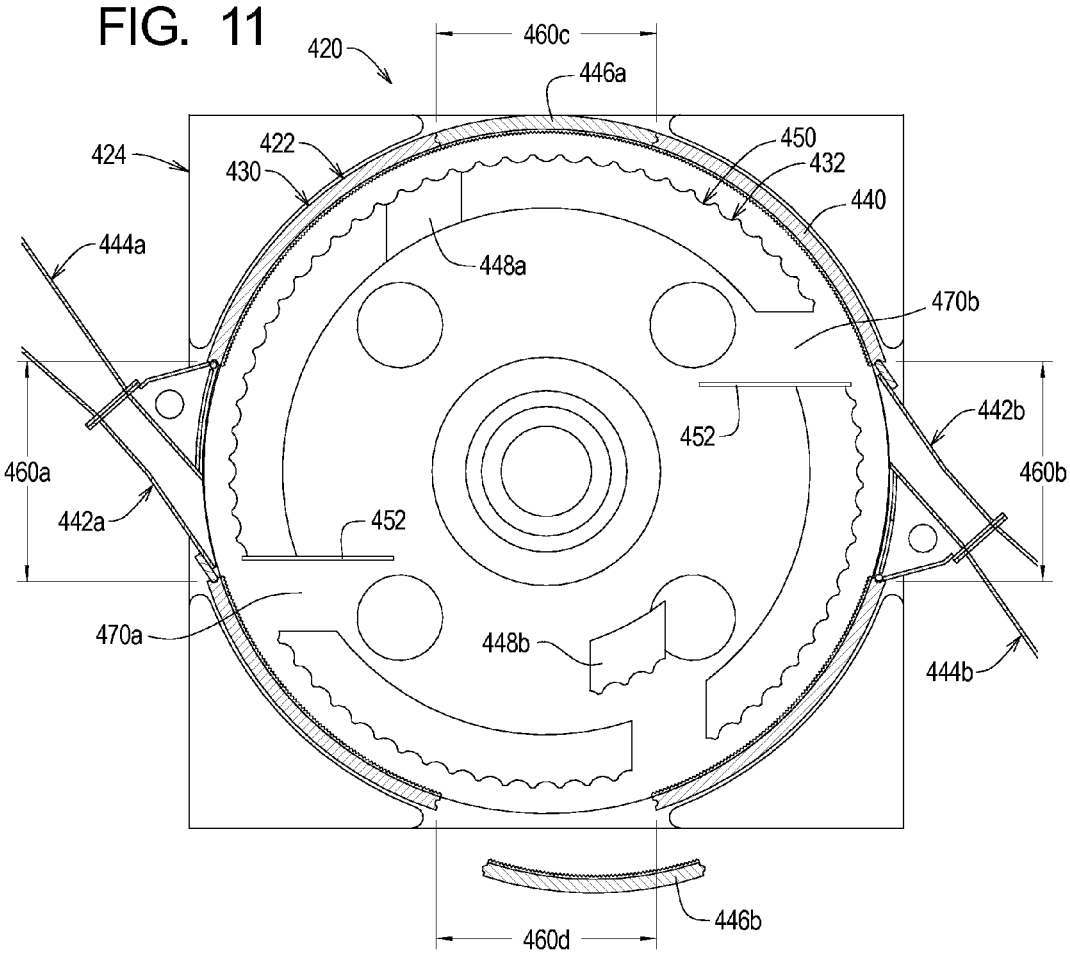
FIG. 11 is a top plan partial section view of a mill housing assembly and an air guide assembly of a second example flour mill system in a first configuration.
Figure 12:
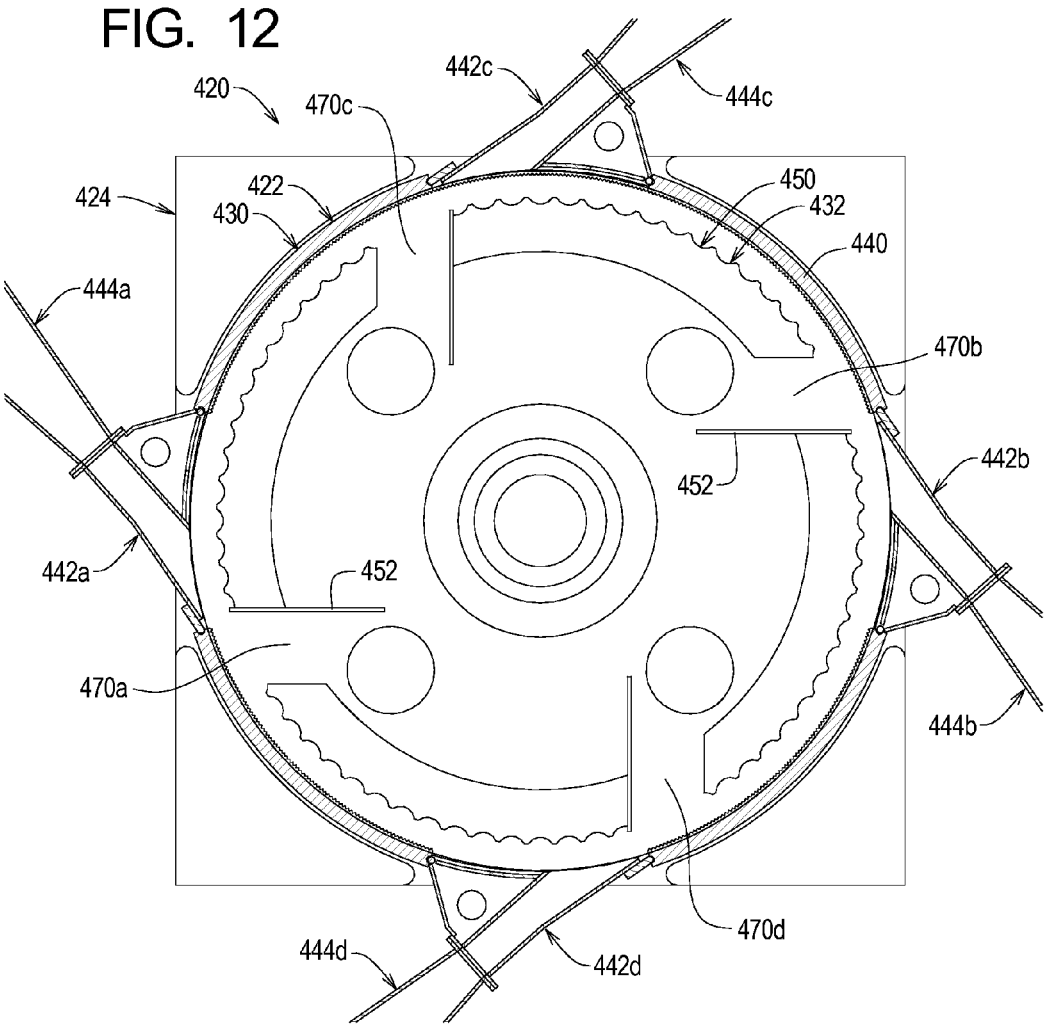
FIG. 12 is a top plan partial section view of the mill housing assembly and the air guide assembly of the second example flour mill system in a second configuration.

Referring now to FIGS. 11 and 12 of the drawing, depicted at therein is a second example flour mill system 420 constructed in accordance with, and embodying, the principles of the present invention. The second example flour mill system 420 comprises a flour mill assembly 422, a support assembly 424, and a motor assembly (not visible in FIGS. 11 and 12). The support assembly 424 and motor assembly are or may be constructed and operated in the same manner as the example support assembly 24 and motor assembly 26 described above and will not be described in detail herein.

FIGS. 11 and 12 illustrate that the second example flour mill assembly 422 comprises a mill housing assembly 430, an air guide assembly 432, and a grinding assembly (not visible in FIGS. 11 and 12). The grinding assembly used by the example flour mill assembly 422 may be similar to the grinding assembly 124 described above and will not be described in further detail.

The mill housing assembly 430 comprises a mill housing 440, a plurality of port assemblies 442, a plurality of collection assemblies 444, a plurality of wall plug plates 446, a plurality of ring plug plates 448, and a top vent plate (not visible in FIGS. 11 and 12). The wall plug plates 446 and ring plug plates 448 allow the second example flour mill assembly 422 to be configured in a two port configuration (FIG. 11) and a four port configuration (FIG. 12). The example air guide assembly 432 comprises upper (not shown) and lower ring assemblies 450, a plurality of upper guide plates (not shown), and a plurality of lower guide plates 452.

To accommodate the two alternative configurations depicted in FIGS. 11 and 12, the example mill housing 440 is provided with four housing ports 460. In particular, the example mill housing assembly 430 thus comprises first, second, third, and fourth port assemblies 442*a*, 442*b*, 442*c*, and 442*d* and first, second, third, and fourth collection assemblies 444*a*, 444*b*, 444*c*, and 444*d*. The example mill housing 440 defines first, second, third, and fourth housing ports 460*a*, 460*b*, 460*c*, and 460*d*. First and second upper wall plug plates (not shown) and first and second lower wall plug plates 446*a* and 446*b* are provided to allow the example mill assembly 422 to be placed into the two and four port configurations. Similarly, First and second upper ring plug plates (not shown) and first and second lower ring plug plates 448*a* and 448*b* allow the example mill assembly 422 to be placed into the two and four port configurations.

To place the second example flour mill assembly 422 in the two port configuration, wall plug plates 446 and ring plug plates 448 are secured relative to the mill housing assembly 430 such that the upper ring assembly (not shown) and lower ring assembly 450 each define only first and second gap paths 470*a* and 470*b* and two of the housing ports 460*c* and 460*d* are blocked as shown in FIG. 11.

To place the second example flour mill assembly 422 in the four port configuration, the ring plug plates 448 are removed, and the upper guide plates (not shown) and the lower guide plates 452 are arranged to define first, second, third, and fourth gap paths 470*a*, 470*b*, 470*c*, and 470*d* as shown in FIG. 12. Similarly, all four of the port assemblies 442*a*, 442*b*, 442*c*, and 442*d* and collection assemblies 444*a*, 444*b*, 444*c*, and 444*d* are connected to the housing ports 460*a*, 460*b*, 460*c*, and 460*d*, again as shown in FIG. 12.

The second example flour mill assembly 422 is more flexible in operation and allows more control over the grinding process to accommodate different product feed rates and characteristics of the product being milled.

III. Third Example

Figure 13:
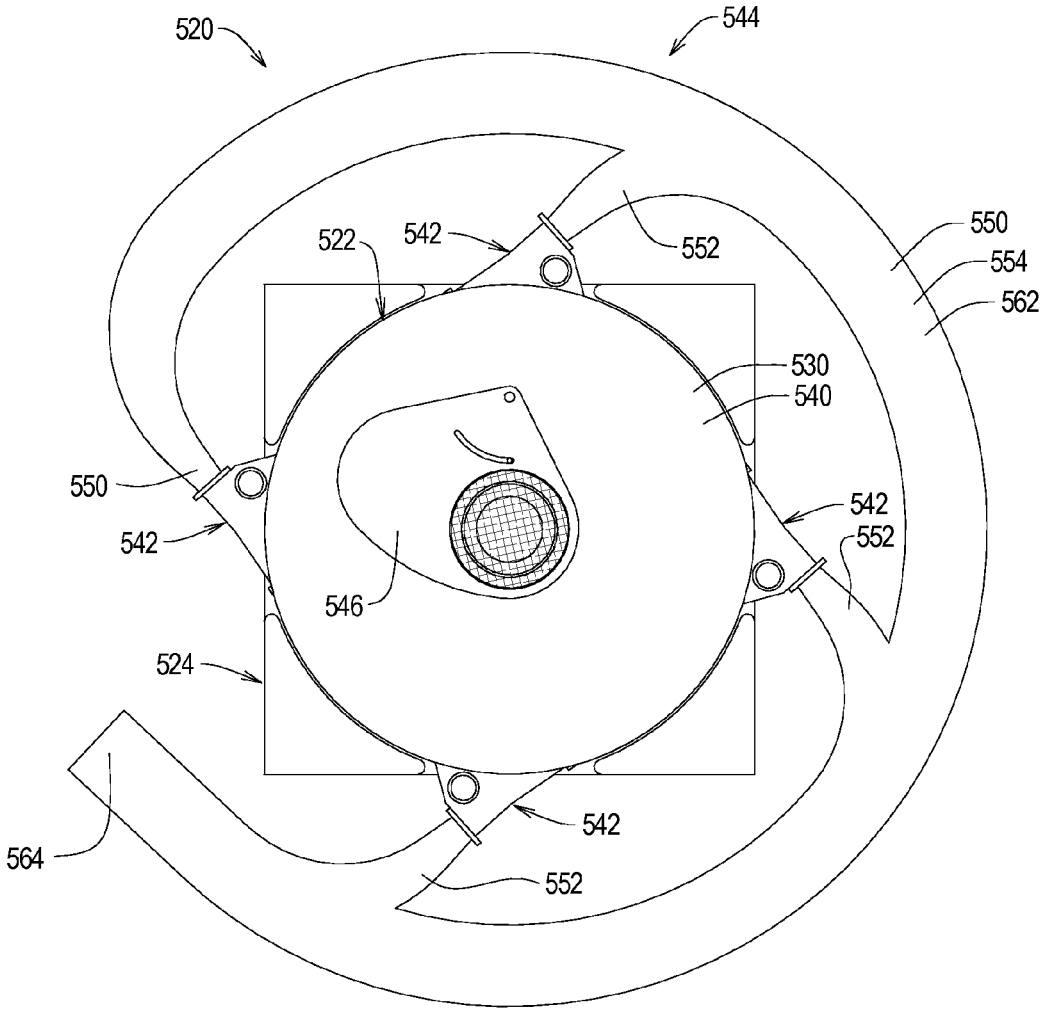
FIG. 13 is a top plan view of a third example flour mill system.

Referring now to FIG. 13 of the drawing, depicted at therein is a third example flour mill system 520 constructed in accordance with, and embodying, the principles of the present invention. The third example flour mill system 520 comprises a flour mill assembly 522, a support assembly 524, and a motor assembly (not visible in FIG. 13). The support assembly 524 and motor assembly are or may be constructed and operated in the same manner as the example support assembly 24 and motor assembly 26 described above and will not be described in detail herein.

FIG. 13 illustrates that the third example flour mill assembly 522 comprises a mill housing assembly 530. The example flour mill assembly 522 further comprises an air guide assembly and a grinding assembly, which are not visible in FIG. 13. The mill housing assembly 530 comprises a mill housing 540, a plurality of port assemblies 542, and a collection assembly 544, a top vent plate 546.

The example collection assembly 544 comprises a primary collection pipe 550 and a plurality of secondary collection pipes 552. The example mill housing 540 defines a substantially cylindrical exterior wall 554, and the primary collection pipe extends at least 270° around the perimeter of the exterior wall 554. In particular, the example primary collection pipe 550 defines an inlet portion 560, a main portion 562, and an outlet portion 564. The inlet portion 560 is connected to one of the plurality of port assemblies 542. The secondary collection pipes 552 are connected between the remaining port assemblies 542 and the main portion 562 of the primary collection pipe. The outlet portion 564 is connected to a vacuum collection system (not shown) for forming a vacuum or low pressure region within the primary collection pipe 550 and for collecting flour entrained within air carried out of the outlet portion 564.

The example collection assembly 544 comprises three of the secondary collection pipes and thus is designed for use with a four port flour mill assembly. An alternate collection assembly of the present invention provided with only one secondary collection pipe may be used for a two port flour mill assembly.

What is claimed is:

1. A mill assembly for processing product, comprising
a mill housing assembly comprising
a mill housing defining a housing chamber, at least first and second housing ports, and at least one vent port,
at least first and second port assemblies secured to the mill housing at the first and second housing ports, respectively, where the first and second port assemblies each defines
an inlet chamber,
an exterior inlet opening,
an outlet chamber, and
an exterior outlet opening, and
at least one collection assembly defining
a collection chamber in fluid communication with the outlet chamber of each of the first and second port assemblies, and
an exterior collection opening;
an air guide assembly arranged within the housing chamber to define
an inlet plenum in fluid communication with at least one vent port,
a wheel chamber, and
at least first and second gap paths associated with the first and second housing ports, respectively; and
a grinding assembly comprising
a rotor member arranged within the housing chamber to define
a grinding chamber, where each of the inlet chambers is in fluid communication with the grinding chamber, and
at least one feed chamber extending between the inlet plenum and grinding chamber, and
a plurality of grinding members supported by the rotor member within the grinding chamber; wherein
the product is arranged at least partly within the grinding chamber through the exterior inlet opening of a given one of the port assemblies and the inlet chamber associated with the given one of the port assemblies;
the rotor member is rotated such that the grinding members grind the product within the collection chamber, and
displace the product being ground from a first position adjacent to the inlet chamber of the first port assembly to a second position adjacent to the outlet chamber of the second port assembly;
air flows along
a first path from the at least one inlet port, through the inlet plenum, the at least one gap path, the grinding chamber, the outlet chamber, and the collection chamber, and out of the exterior collection opening, and
a second path from the at least one inlet port, through the inlet plenum, the at least one feed chamber, the grinding chamber, the outlet chamber, and the collection chamber, and out of the exterior collection opening;
the air flowing along the first and second paths carries ground product from the grinding chamber into the outlet chamber, through the collection chamber, and out of the exterior collection opening; and
a feed/collection ratio of the exterior inlet opening to the exterior outlet opening is at least approximately 1.5:1.

2. A mill assembly as recited in claim 1, in which the feed/collection is substantially between 1.5:1 and 5.0:1.

3. A mill assembly as recited in claim 1, in which the feed/collection is approximately 2.0:1.

4. A mill assembly as recited in claim 1, in which a seal is formed between each of the first and second port assemblies and the mill housing substantially around the first and second housing ports.

5. A mill assembly as recited in claim 4, in which the seal is formed by:
a seal rod formed on each of the first and second housing ports;
a seal member attached to each of the first and second housing ports; and
seal tape that is adhered to each of the first and second housing ports and the mill housing.

6. A mill assembly as recited in claim 1, further comprising:
at least one ring plug plate; and
at least one wall plug plate; wherein
the housing defines at least first, second, and third housing ports; and
the mill assembly operates in
a first mode in which
the at least one ring plug plate and the at least one wall plug plate are detached from the mill housing, and
the first port assembly, the second assembly, and a third port assembly are secured to the housing at the first, second, and third housing ports, respectively, and
a second mode in which
the at least one ring plug plate and the at least one wall plug plate are attached to the mill housing to prevent air from flowing out of the third housing port, and
the first and second port assemblies are secured to the housing at the first and second housing ports, respectively.

7. A mill assembly as recited in claim 1, further comprising:
first and second ring plug plates; and
first and second wall plug plates; wherein
the housing defines first, second, third, and fourth housing ports; and
the mill assembly operates in
a first mode in which the first and second ring plug plates and the first and second wall plug plates are detached from the mill housing, and the first port assembly, the second port assembly, a third port assembly, and a fourth port assembly are secured to the housing at the first, second, third, and fourth housing ports, respectively, and a second mode in which the first and second ring plug plates and the first and second wall plug plates are attached to the mill housing to prevent air from flowing out of the third and fourth housing ports, respectively, and the first and second port assemblies are secured to the housing at the first and second housing ports, respectively.

8. A mill assembly for processing product, comprising a mill housing assembly comprising a mill housing defining a housing chamber, at least first and second housing ports, and at least one vent port, at least first and second port assemblies secured to the mill housing at the first and second housing ports, respectively, where the first and second port assemblies each defines an inlet chamber, an exterior inlet opening, an outlet chamber, and an exterior outlet opening, and at least one collection assembly defining a collection chamber in fluid communication with the outlet chamber of each of the first and second port assemblies, and an exterior collection opening;

a seal is formed between each of the first and second port assemblies and the mill housing substantially around the first and second housing ports;

an air guide assembly arranged within the housing chamber to define an inlet plenum in fluid communication with at least one vent port, a wheel chamber, and at least first and second gap paths associated with the first and second housing ports, respectively; and a grinding assembly comprising a rotor member arranged within the housing chamber to define a grinding chamber, where each of the inlet chambers is in fluid communication with the grinding chamber, and at least one feed chamber extending between the inlet plenum and grinding chamber, and a plurality of grinding members supported by the rotor member within the grinding chamber; wherein the product is arranged at least partly within the grinding chamber through the exterior inlet opening of a given one of the port assemblies and the inlet chamber associated with the given one of the port assemblies;

the rotor member is rotated such that the grinding members grind the product within the collection chamber, and displace the product being ground from a first position adjacent to the inlet chamber of the first port assembly to a second position adjacent to the outlet chamber of the second port assembly;

air flows along a first path from the at least one inlet port, through the inlet plenum, the at least one gap path, the grinding chamber, the outlet chamber, and the collection chamber, and out of the exterior collection opening, and a second path from the at least one inlet port, through the inlet plenum, the at least one feed chamber, the grinding chamber, the outlet chamber, and the collection chamber, and out of the exterior collection opening;

the air flowing along the first and second paths carries ground product from the grinding chamber into the outlet chamber, through the collection chamber, and out of the exterior collection opening.

9. A mill assembly as recited in claim 8, in which the seal is formed by:

a seal rod formed on each of the first and second housing ports;

a seal member attached to each of the first and second housing ports; and seal tape that is adhered to each of the first and second housing ports and the mill housing.

10. A mill assembly as recited in claim 8, in which a feed/collection ratio of the exterior inlet opening to the exterior outlet opening is substantially between 1.5:1 and 5.0:1.

11. A mill assembly as recited in claim 8, in which a feed/collection ratio of the exterior inlet opening to the exterior outlet opening is approximately 2.0:1.

12. A mill assembly as recited in claim 8, further comprising:

at least one ring plug plate; and at least one wall plug plate; wherein the housing further defines at least a third housing port; and the mill assembly operates in a first mode in which the at least one ring plug plate and the at least one wall plug plate are detached from the mill housing, and the first port assembly, the second assembly, and a third port assembly are secured to the housing at the first, second, and third housing ports, respectively, and a second mode in which the at least one ring plug plate and the at least one wall plug plate are attached to the mill housing to prevent air from flowing out of the third housing port, and the first and second port assemblies are secured to the housing at the first and second housing ports, respectively.

13. A mill assembly as recited in claim 8, further comprising:

first and second ring plug plates; and first and second wall plug plates; wherein the housing further defines third and fourth housing ports; and the mill assembly operates in a first mode in which the first and second ring plug plates and the first and second wall plug plates are detached from the mill housing, and the first port assembly, the second port assembly, a third port assembly, and a fourth port assembly are secured to the housing at the first, second, third, and fourth housing ports, respectively, and a second mode in which the first and second ring plug plates and the first and second wall plug plates are attached to the mill housing to prevent air from flowing out of the third and fourth housing ports, respectively, and the first and second port assemblies are secured to the housing at the first and second housing ports, respectively.

14. A mill assembly for processing product, comprising
a mill housing assembly comprising
a mill housing defining a housing chamber, at least first, second, and third housing ports, and at least one vent port,
at least first, second, and third port assemblies selectively detachably attached to the mill housing at the first, second and/or third housing ports, respectively, where the port assemblies each defines
an inlet chamber,
an exterior inlet opening,
an outlet chamber, and
an exterior outlet opening, and
at least one collection assembly defining
a collection chamber in fluid communication with the outlet chamber of each of the first and second port assemblies, and
an exterior collection opening;
an air guide assembly arranged within the housing chamber to define
an inlet plenum in fluid communication with at least one vent port,
a wheel chamber, and
at least first, second, and third gap paths associated with the first, second, and third housing ports, respectively; and
a grinding assembly comprising
a rotor member arranged within the housing chamber to define
a grinding chamber, where each of the inlet chambers is in fluid communication with the grinding chamber, and
at least one feed chamber extending between the inlet plenum and grinding chamber, and
a plurality of grinding members supported by the rotor member within the grinding chamber;
at least one ring plug plate; and
at least one wall plug plate; wherein
the product is arranged at least partly within the grinding chamber through the exterior inlet opening of a given one of the port assemblies and the inlet chamber associated with the given one of the port assemblies;
the rotor member is rotated such that the grinding members grind the product within the collection chamber, and displace the product being ground along the grinding chamber;
air flows along
a first path from the at least one inlet port, through the inlet plenum, the at least one gap path, the grinding chamber, the outlet chamber, and the collection chamber, and out of the exterior collection opening, and
a second path from the at least one inlet port, through the inlet plenum, the at least one feed chamber, the grinding chamber, the outlet chamber, and the collection chamber, and out of the exterior collection opening;
the air flowing along the first and second paths carries ground product from the grinding chamber into the outlet chamber, through the collection chamber, and out of the exterior collection opening; and
the mill assembly operates in
a first mode in which
the at least one ring plug plate and the at least one wall plug plate are detached from the mill housing, and
the first port assembly, the second assembly, and a third port assembly are secured to the housing at the first, second, and third housing ports, respectively, and
a second mode in which
the at least one ring plug plate and the at least one wall plug plate are attached to the mill housing to prevent air from flowing out of the third housing port, and
the first and second port assemblies are secured to the housing at the first and second housing ports, respectively, and
the third port assembly is detached from the third housing port.

15. A mill assembly as recited in claim 14, in which a feed/collection ratio of the exterior inlet opening to the exterior outlet opening is substantially between 1.5:1 and 5.0:1.

16. A mill assembly as recited in claim 14, in which a feed/collection ratio of the exterior inlet opening to the exterior outlet opening is approximately 2.0:1.

17. A mill assembly as recited in claim 14, in which a seal is formed between each of the first and second port assemblies and the mill housing substantially around the first and second housing ports.

18. A mill assembly as recited in claim 17, in which the seal is formed by:
a seal rod formed on each of the first and second housing ports;
a seal member attached to each of the first and second housing ports; and
seal tape that is adhered to each of the first and second housing ports and the mill housing.

19. A mill assembly as recited in claim 14, comprising:
first and second ring plug plates; and
first and second wall plug plates; wherein
the housing further defines a fourth housing port; and
the mill assembly operates in
a first mode in which
the first and second ring plug plates and the first and second wall plug plates are detached from the mill housing, and
the first port assembly, the second port assembly, a third port assembly, and a fourth port assembly are secured to the housing at the first, second, third, and fourth housing ports, respectively, and
a second mode in which
the first and second ring plug plates and the first and second wall plug plates are attached to the mill housing to prevent air from flowing out of the third and fourth housing ports, respectively, and
the first and second port assemblies are secured to the housing at the first and second housing ports, respectively, and
the third and fourth port assemblies are detached from the third and fourth housing ports, respectively.

20. A method of processing product comprises the steps of:
providing a mill housing assembly defining a housing chamber;
providing at least first and second port assemblies defining an exterior inlet opening and an exterior outlet opening, where a feed/collection ratio of the exterior inlet opening to the exterior outlet opening is at least approximately 1.5:1;
attaching at least one collection assembly to the at least first and second port assemblies;
mounting an air guide assembly within the housing chamber to define a grinding chamber;
providing a grinding assembly comprising a plurality of grinding members arranged within the grinding chamber;

introducing the product into the grinding chamber through the exterior inlet opening;

rotating the grinding member such that the grinding members grind the product within the grinding chamber;

causing air to flow through the mill housing assembly such that ground product is carried out of the first and second port assemblies through the exterior outlet opening.

* * * * *